United States Patent [19]

Mate

[11] Patent Number: 4,469,081

[45] Date of Patent: Sep. 4, 1984

[54] IGNITION COIL CONTROL DEVICE FOR REGULATING THE OPTIMAL CONDUCTION TIME FOR AN INTERNAL COMBUSTION ENGINE

[75] Inventor: Jean-Luc Mate, Toulouse, France

[73] Assignee: Renix Electronique S.A., Toulouse, France

[21] Appl. No.: 316,281

[22] Filed: Oct. 29, 1981

[30] Foreign Application Priority Data

Nov. 4, 1980 [FR] France ..... 80 23509

[51] Int. Cl.[3] ..... F02P 5/08

[52] U.S. Cl. ..... 123/609; 123/417; 123/644

[58] Field of Search ..... 123/609, 644, 416, 417

[56] References Cited

U.S. PATENT DOCUMENTS

| | | | |
|---|---|---|---|
| 4,127,091 | 11/1978 | Leichle | 123/416 |
| 4,248,195 | 2/1981 | Gorille | 123/609 X |
| 4,298,941 | 11/1981 | Furuhashi | 123/609 X |
| 4,321,580 | 3/1982 | Deleris | 340/870.24 |
| 4,324,217 | 4/1982 | Ina et al. | 123/417 |
| 4,347,570 | 8/1982 | Akiyama et al. | 123/609 X |

FOREIGN PATENT DOCUMENTS

| | | | |
|---|---|---|---|
| 142965 | 11/1980 | Japan | 123/609 |

*Primary Examiner*—Parshotam S. Lall
*Assistant Examiner*—W. R. Wolfe
*Attorney, Agent, or Firm*—Oblon, Fisher, Spivak, McClelland & Maier

[57] ABSTRACT

An ignition coil control device output stage of a calculator (2) has a transfer function of the form: $tc = N.TSD + \epsilon$ where $\epsilon$ is a small and known quantity; tc is the conduction time of the coil, N is a number of angular fractions or periods of an interpolation signal; and TSD is the period corresponding to one tooth on the starter gear. The device comprises measurement means (1, 32, 36) for measuring the time strictly necessary to obtain the required energy; means (6, 9, 13, 17) for generating signals at each fraction of the angular marking signal in order to obtain a time measurement of a counting window and means (21, 25, 29) for counting and memorizing during this window an interpolation signal of the angular resolution n times higher.

10 Claims, 6 Drawing Figures

TSD
3=N
Tc
Tc
na
t=Kna
N=3
TSD/n
ℓ1
ℓ2
ℓ3
ℓ4
ℓ5

IGNITION COIL CONTROL DEVICE FOR REGULATING THE OPTIMAL CONDUCTION TIME FOR AN INTERNAL COMBUSTION ENGINE

BACKGROUND OF THE INVENTION

1. Field of the Invention

The present invention relates generally to an ignition coil control device and more particularly to an ignition control device for regulating the optimal conduction time of the coil for an internal combustion engine.

2. Description of the Prior Art

In the traditional ignition system, the spark causing the ignition of the explosive mixture contained inside a cylinder of an internal combustion engine is produced by a burst of electric current circulating in the primary circuit of a coil. This burst produces an overvoltage in the secondary circuit which is connected to the spark plugs. The primary electric circuit of the coil must then remain closed for a sufficient time to restore the current necessary to obtain the required energy in said coil.

In so-called transistorized ignitions where the traditional burst mechanism is replaced by a position sensor which controls a power transistor, the primary circuit opening time remains constant and is equal to the minimum time needed to produce a spark. This solution, as well as the traditional solution, presents a major inconvenience at slow speed since the current consumed is greater than to the current strictly necessary to restore sufficient energy to the coil.

Another solution provides for controlling the coil at a constant operating time regardless of the rotational speed of the engine. If this time is exactly equal to the necessary coil recharge time, the ignition circuit consumes the minimum amount of current. One solution of this type applied to a "totally electronic" ignition, where the power transistor system is controlled by a calculator which determines at each moment the angle of ignition advance, is the object of the French Pat. No. 2,358,564, filed on July 15, 1976 under the name of Regie nationale des usines RENAULT for a "constant conduction time control device for a combustion motor ignition coil". This solution is adapted to all types of electronic ignition advance calculators and presents the advantage of adjusting the constant conduction time parameters aided by the use of a programmable logic array (PLA). But the problem that is resolved by this patent application involves a number of parameters reduced to attain the least expensive solution and also relates to the immunity of the device in regard to the acceleration constraints which the solution must be able to tolerate.

SUMMARY OF THE INVENTION

Accordingly, one object of this invention is to provide a novel ignition control device capable of accurate and reliable operation.

Another object of this invention is to control the coil current so as to only expend the amount of current necessary.

A further object of this invention is to provide a solution having general application while eliminating restrictions.

A still further object of this invention is to provide a control device capable of performance at all speeds of the engine.

An additional object of the present invention is to control the coil current so as to limit the time of conduction.

Briefly, these and other objects of the invention are achieved by providing an ignition coil control device for regulating the optimal conduction time for a combustion motor, where the device is connected to the output of an ignition advance calculator with a transfer function of the form: $t_c$ generated$=N \cdot TSD+\epsilon$, in which:

$\epsilon$ is a small and known quantity $t_c$, generated is the coil conduction time, N is the number of angular fractions or periods of an angular reference signal and, TSD is the period of the angular marking signal corresponding to an angular mark such that a tooth of the crown of the starter associated wih the motor, said device includes devices to measure, from data supplied by the calculator, the time $t_c$ measured strictly necessary to obtain the nominal energy at the coil terminals, a first clock of period $TH_2$, a first counter incremented by the first clock during time $t_c$ measured up to a number NA so that: $NA=t_c$ measured$/TH_2$, a second clock of period $TH_1$, a second counter incremented, at each period TSD of the angular marking signal, by the second clock during a time $t_o=NB \cdot TH_1$ such that NB=NA, and a third counter incremented during time $t_o$ by an interpolation signal of period TSD/n up to a number $$N = \frac{n \cdot t_o}{TSD} = \frac{n}{TSD} \cdot \frac{TH_1}{TH_2} \cdot t_c \text{ measured,}$$

so that the optimum conduction time calculated by the device is:

$$t_c \text{ calculated} = N \cdot TSD = n \cdot \frac{TH_1}{TH_2} \cdot t_c \text{ measured}$$

said number N being sent to the output stage (2) of the calculator.

According to a characteristic of the invention, the first counter is preloaded by a load signal with a number nt, the optimum conduction time calculated by the device being:

$$t_c \text{ calculated} = n \cdot \frac{TH_1}{TH_2} (t_c \text{ measured} + nt \cdot TH_2)$$

DESCRIPTION OF THE PREFERRED EMBODIMENTS

Figure 1:
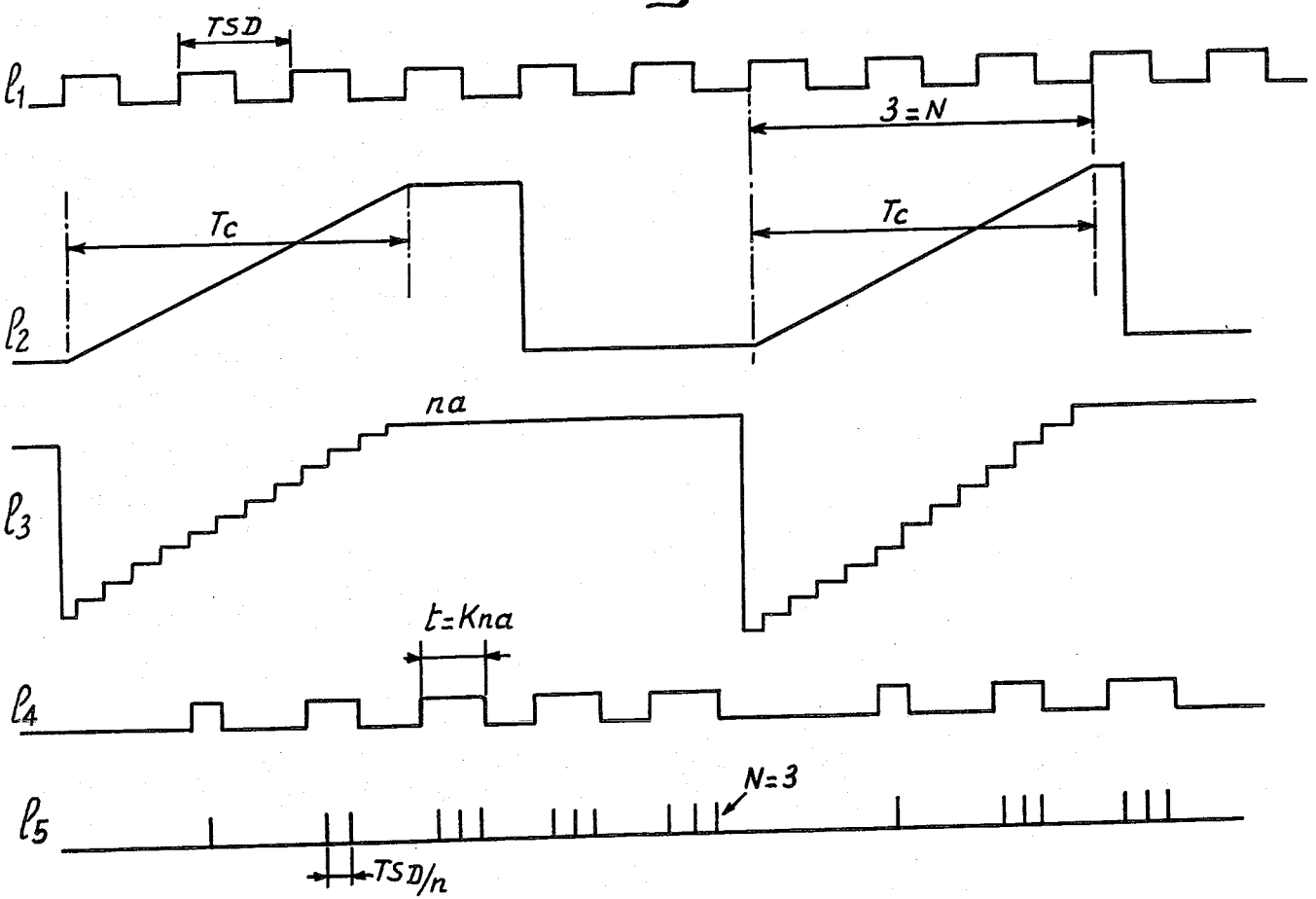
FIGS. 1 and 2 are diagrams of a group of signals allowing one to pinpoint the problem resolved by the present invention.

Referring now to the drawings, wherein like reference numerals designate identical or corresponding parts throughout the several views, and more particularly to FIG. 1 thereof, wherein the chronogram of FIG. 1 shows:

on line 1 the angular marking signal of period TSD;

on line 2 the current crossing the coil;

on line 3 the evolution of the contents NA of a counter for measuring time $t_c$ strictly necessary to obtain the nominal energy at the coil terminals;

on line 4 the angular measurement window having a duration $t_o$ proportional to the measurement of strictly necessary time $t_c$, generated at each fraction of the marking signal, as a result of the incrementation of a counter whose contents NB is permanently compared with contents NA of the time counter;

on line 5 the evolution of the number N obtained by counting of a resolution interpolation signal n times higher than the signal of line 1 during the window of line 4.

Figure 2:
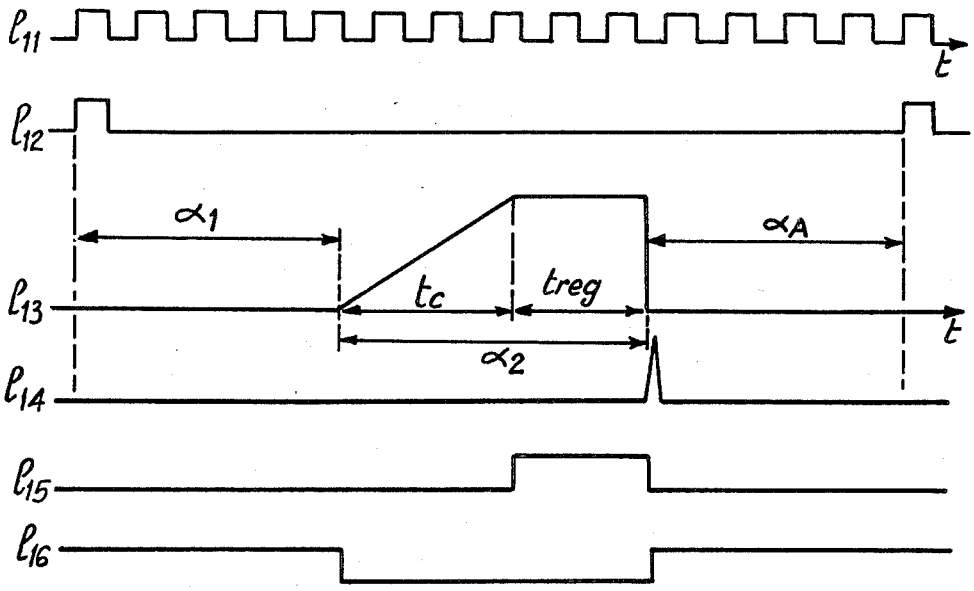

FIG. 2 shows successively:

on line 11, the signal, hereinafter designated TSD, which is the toothed signal or angular marking signal issued from the starting gear and provided by means of a proximity sensor, on line 12, two successive top dead center points (TDC), on line 13, the form of the current passing through the primary circuit of the ignition coil, on line 14, the instant when the spark plug fires, on line 15, a control signal corresponding to the control time "$t_{reg}$" of line 13 and, on line 16, the ignition signal at the output of the calculator through its lead 110 in FIG. 3.

The signal illustrated by line 1 in FIG. 1 is the same as that shown by line 11 in FIG. 2. The scale is different.

The object of the present invention is provided to minimize $t_{reg}$, the so-called control time of the primary coil current during the generation of the supply signal in the primary ignition coil circuit, line 13, FIG. 2. There $\alpha 2$ represents the conduction time effectively generated in each half revolution $T_o$ of the motor and is made up as follows:

$t_c$: conduction time strictly necessary to obtain the required current across the coil, $t_{reg}$: control time during which the required current is maintained across the coil up to the moment of ignition represented by line 14 and during which the power control device must dissipate non-negligable energy in order to assure said control.

The measure of $t_c$ during a half turn $T_o$ permits in the following half turn the application of the optimal value of N, the number of angular fractions or angular marking signal periods, leading to the generation of a total time $\alpha 2$ close to $t_c$ and lower than $T_o$ to inputs 107 of an adder 101 in the output stage of the calculator illustrated in FIG. 3.

It is true that $t_c$ remains constant from one half turn to the next, depending on the value of the battery current, the proper value of the ignition coil self-inductance and the apparent resistance of the charge circuit. The only fundamental quantity which varies according to the invention is thus the time $t_c$ which allows constant recalculation of the number of angular fractions N present at the output stage of the calculator in order to reconstitute the time $t_c$ in the best possible way, whatever the instant rotational speed of the engine.

Figure 3:
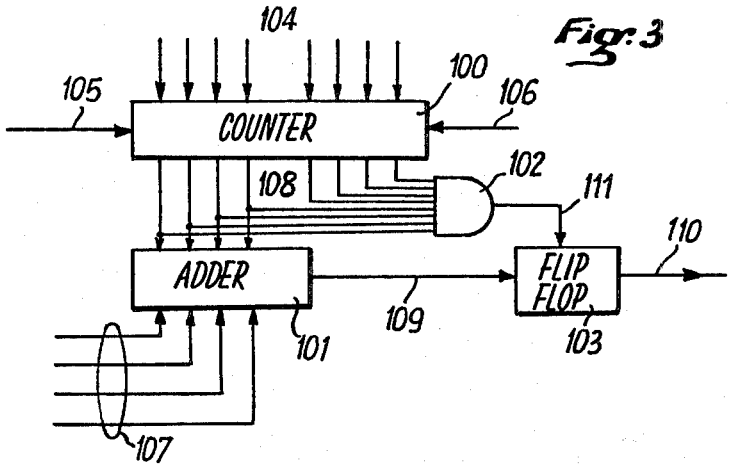
FIG. 3 is schematic diagram of the output stage of a digital ignition advance calculator suitable for use in association with the control device according to the present invention.

FIG. 3 is a schematic diagram of the output stage of a digital ignition advance calculator usable in association with the control device of to the present invention.

According to the representation of FIG. 3 the output stage of the calculator comprises a counter accumulator 100 connected by leads 104 to the output of a memory, which is not shown, in order to receive a digital angular value No representing the generated advance. The counter accumulator 100 also has a load input 106 connected to a sequencer—not shown—and a counting input 105 through which it receives the TSD signal shown by line 1 in FIG. 1. The higher value half of the outputs 108 of the counter accumulator 100 is connected to the input of adder 101 and all the outputs 108 of the counter accumulator 100 are connected in addition to the inputs of a logical AND gate 102. The output 111 of gate 102 is connected to the reset input of a bi-stable trigger circuit (flip-flop) 103 whose activation input is connected to the output lead 109 of the adder comparer 101. This comparator has limited capacity and when there is an overflow, it emits an impulse through its lead 109 to activate the flip-flop 103. The flip-flop 103 sends the command signal of the coil as is illustrated by line 16 of FIG. 2 directly through its output lead 110. The result of the addition in 101 of the number N and the contents of the angular counter 100 initiates the time of conductivity N.TSD before the instant of ignition. The number N is thus exactly equal to the number of angular fractions or angular marking signal periods shown on line 11 of FIG. 2 which separates the initiation of conductivity from the instant of ignition.

FIG. 3 is a representation of the output stage of the ignition advance calculator such as is described in the U.S. Pat. No. 4,127,091. In that the output stage of all ignition advance calculators having a transfer function of the form: $t_c = N \cdot TSD + \epsilon$ wherein $\epsilon$ is a small and known quantity, all other quantities having been previously defined, is satisfactory for use with the control device according to the present invention.

According to the diagram in FIG. 4, the output stage 2 of the calculator, such as described in connection with FIG. 3, produces signals on two leads 37 and 38 in the direction of a logic block 36. Lead 37 transmits the successive ignition signals as are shown in FIG. 2, line 16 and FIG. 5, line 2. Lead 38 transmits control signals as are shown in FIG. 2, line 15 and FIG. 5, line 3. Line 1 of FIG. 5 represents two successive PMH's. The logic block 36 is connected by a first output 39 to the input of a logical AND gate 32 which carries the signal shown on line 4, of FIG. 5 and which is representative of the conduction time $t_c$ strictly necessary for the coil, hereafter called $t_c$ measured. The second input 34 of the logic gate 32 is energized by the clock $H_2$ with the period $TH_2$ corresponding to the illustration of line 5, FIG. 5. The pulses at output 33 of the logical AND gate 32 and which are shown on line 7 of FIG. 5, are counted by counter 1 by way of its clock input connected to conductor 33. The logic block 36 is connected by a second output 41 to the reset input of the counter 1 which receives an impulse such as represented on line 6 of FIG. 5 preliminary to receiving impulses originating at the logical AND gate 32. At the end of time $t_c$ measured (4, FIG. 5), the counter 1 presents at the outputs 5 a number NA defined as follows:

$$NA = t_c \text{ measured}/TH_2$$

A comparator 6 compares on the one hand the outputs 5 of the first counter 1, and on the other hand, the outputs 12 of a second counter 9 whose clock input 10 is connected to the output of a logical AND gate 13.

Figure 6:
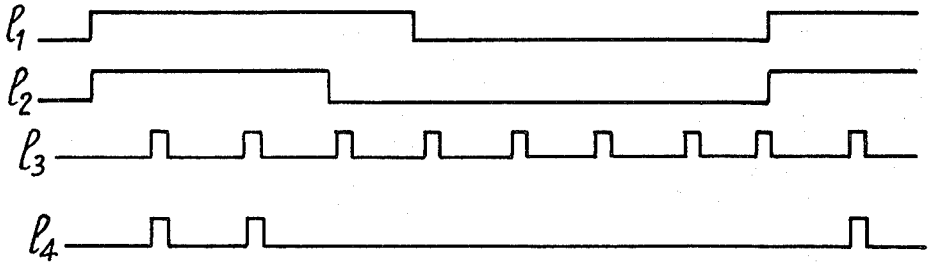
FIGS. 5 and 6 are timing diagrams of various signals present in the circuit of the invention.

This logic gate 13 is energized at its input 15 by a signal indicating the onset of counting which is synchronous with the angular marking signal as represented on line 1 of FIG. 6, and at its second input 4 by a clock $H_1$ with the period $TH_1$. These are the pulses arising at the output 10 of the logic gate 13 which increases the counter 9 through its clock input, the same having been reset to zero by its input 11 with the help of a pulse synchronous with the angular marking signal and preceding the first pulse arising at input 15.

The clock input 19 of a type D flip-flop 17 recieves the onset signal at the same time that input 15 of the logic gate 13 has brought its output 20 to a high state as shown on line 2 of FIG. 6. When the contents of the counter 9 reaches a value of NB=NA, after a time equal to $NB \cdot TH_1$, the output of comparator 6 is activated and brings the flip-flop circuit 17 to zero. The resulting signal illustrated by line 2 of FIG. 6 with a duration of $NB \cdot TH_1$ is applied to input 20 of a logical AND gate 2. The second input 22 of the logic gate 21 is activated by pulses having a period TSD/n shown by line 3, FIG. 6. The frequency multiple n of the angular marking signal TSD, may be produced in conformity with the teaching of U.S. Pat. No. 4,321,580.

The number of pulses leaving the logical AND gate 21 is equal to $N=t_o/TSD/n$. These are counted through the clock input 24 of a counter 25, which was previously reset to zero through its input 26 by the same signal as that applied to counter 9 through its input 11. The result of the counting N appears at outputs 28 of counter 25 and is stored in a memory 29 which is activated through its load input 30 by a signal synchronous with the angular marking signal preceding the zero resetting impulse of counters 9 and 25. This is the same number N at outputs 31 of memory 29 that is applied to the inputs 107 of the output stage of the electronic calculator 2, as has been explained in reference to FIG. 3.

Line 4 of FIG. 6 shows the number of impulses of period TSD/n passing across the measurement window illustrated by line 2 of FIG. 6, Thus, the calculated conduction time is equal to: $t_c$ generated=N.TSD or:

$$N = \frac{t_o}{TSD/n} = \frac{NB \cdot TH_1}{TSD/n}$$

$$NB = NA = \frac{t_c \text{ measured}}{TH_2} \text{ hence}$$

$$t_c \text{ calculated} = n \frac{TH_1}{TH_2} \cdot t_c \text{ measured(1), and}$$

$$t_c \text{ generated} = n \cdot \frac{TH_2}{TH_2} \cdot t_c \text{ measured} + \epsilon$$

The technician may use any value with $n \cdot TH_1/TH_2$ that he judges useful, particularly one that makes it possible to permanently obtain the equation:

$$t_{c\ calculated} = t_{c\ measured}$$

The described device warrants the implantation of two precharge numbers or offsets into the counters 1 and 25 of FIG. 4, which are explained as follows:

precharging a value nt into counter 1 through its input 41.

precharging a value nd into counter 25 through its input 26. The output is:

$$t_{c\ calculated} = (t_{c\ measured} + nt \cdot TH_2) \cdot n \frac{TH_1}{TH_2} + nd \cdot TSD \quad (2)$$

One will note that if input 41 of counter 1 and input 26 of counter 25 correspond to their zero reset inputs, the output function is described by equation (1) above.

The control device that is the object of the present invention makes it possible, during the initialization phase of vehicle starting, to program, for the first generated ignition, a conduction time constant and equal to the maximum conduction time found under extreme operating conditions.

Figure 4:
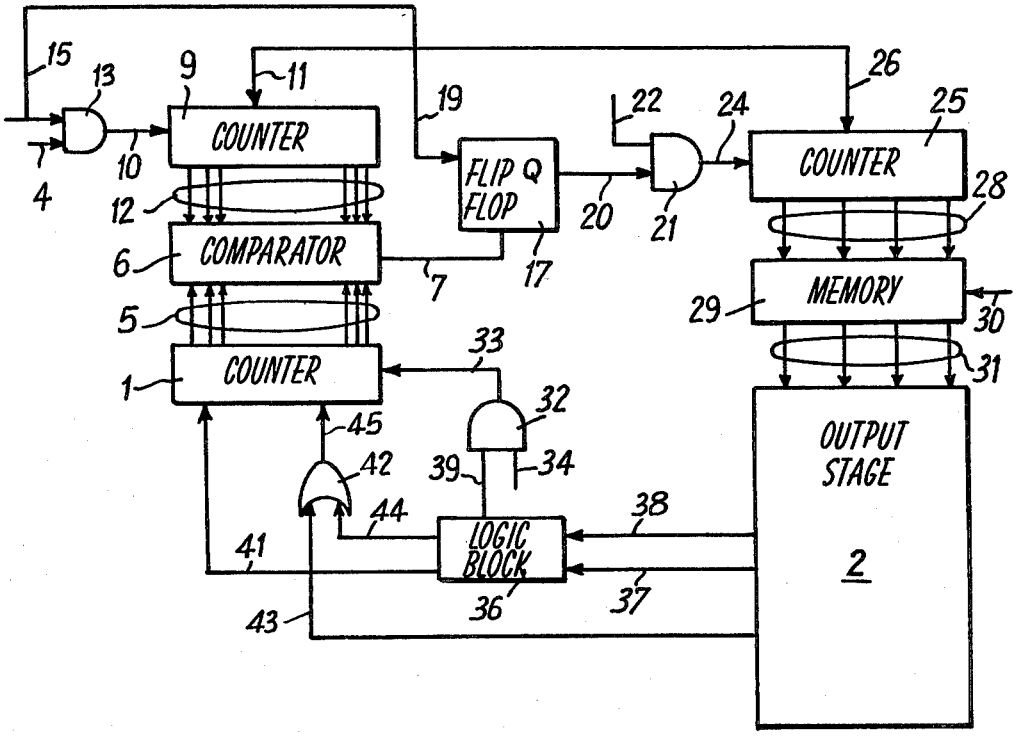
FIG. 4 is a schematic diagram of an embodiment of a control device according to the present invention.
Figure 5:
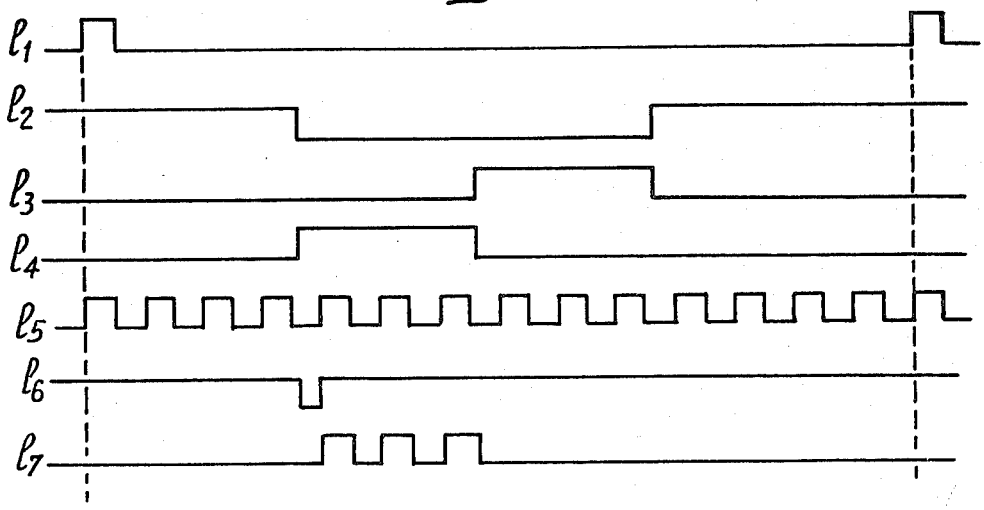

The initialization signal emitted by calculator 2 of FIG. 4 reaches, by way of lead 43, a first input of a logical OR gate 42 which activates the charging input of counter 1 through its output 45. $n\ max = t_{c\ max}/TH_2$ conducts if $\delta_i = 1$ and $\overline{\delta_i} = 0$ during the generation initialization phase leaving calculator 2.

$$t_{c\ calculated} = (t_{c\ measured} + nt \cdot TH_2) \cdot n \frac{TH_1}{TH_2} \cdot \overline{\delta_i} + n\ \max \cdot TH_2 \cdot \delta_i \cdot \left( n\ (x) \frac{TH_1}{TH_2} \right) + nd \cdot TSD$$

It is possible to integrate into the device according to the invention a security function in the situation where the information relative to the degree of control represented on line 15 of FIG. 2 would be lacking. Input 38 of logic block 36 would not have detected the presence of the latter signal; said logic block 36 generates at its third output 44 a load pulse that is transmitted to counter 1 by way of the same logical OR gate 42 previously noted.

If $\delta_p = 1$ and $\overline{\delta_p} = 0$ at the moment when one loses the control information on lead 38 is lost it can be written at the output of calculator 2:

$$t_{c\ calculated} = (t_{c\ measured} + nt \cdot TH_2) \cdot n \frac{TH_1}{TH_2} (\overline{\delta_i} + \overline{\delta_p}) + n \cdot \frac{TH_1}{TH_2} \cdot (\delta_i + \delta_p) \cdot n\ \max \cdot TH_2 + nd \cdot TSD$$

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Ignition coil control device for regulating the optimal conduction time for combustion motor associated with the output stage of an ignition advance calculator having a transfer function of the form:

$$t_{c\ generated} = N \cdot TSD + \epsilon,$$

$\epsilon$ is a weak and known quantity, $t_c$ generated is the coil conduction time, N is the number of angular fractions of periods of an angular reference signal, and TSD is the period of the angular marking signal corresponding to an angular mark such that a tooth of the crown of the starter associated with the motor, wherein said device comprises:

means to measure, from data supplied by the calculator, time $t_{c\ measured}$ strictly necessary to obtain the nominal energy at the coil terminals, a first clock of period $TH_2$, a first counter incremented by the first clock during time$_{c\ measured}$ up to a number NA so that: $NA = t_{c\ measured}/TH_2$, a second clock of period $TH_1$, a second counter incremented, at each period TSD of the angular marking signal, by the second clock during a time $t_o = NB \cdot TH_1$ such that NB=NA, and a third counter incremented during time $t_o$ by an interpolation signal of period TSD/n up to a number $$N = \frac{n \cdot t_o}{TSD} = \frac{n}{TSD} \cdot \frac{TH_1}{TH_2} \cdot t_{c\ measured}$$

so that the optimum conduction time calculated by the device is:

$$t_{c\ calculated} = N \cdot TSD = N \cdot \frac{TH_1}{TH_2} \cdot t_{c\ measured}$$

said number N being sent to the output stage of the calculator.

2. Device as in claim 1, wherein the first counter is preloaded by a load signal with a number nt, the optimum conduction time calculated by the device being:

$$t_{c\ calculated} = n \cdot \frac{TH_1}{TH_2} (t_{c\ measured} + nt\ TH_2).$$

3. Device as in claim 2, wherein the measuring means comprise a logic block connected by two of its inputs to two outputs of the output stage of the calculator to receive from it respectively the conduction signal of the coil and a control signal active during the attaining of the nominal energy at the terminals of the coil, the logic block delivering on a first output, to a logic gate with function ET, a counting authorization signal of a time equal to said time $t_{c\ measured}$ necessary to obtain the nominal energy at the terminals of the coil and, on a second output, to the first counter, the load signal preceding the counting authorization signal, the logic gate with function ET being connected by a second input to the first clock and by its output to the input of clock of the first counter.

4. Device as in claim 3, wherein the logic block is connected by a third output to a first input of a logic gate with a function OU to supply a load pulse to an input of the first counter in the absence of the control signal, a second input of the logic gate with function OU being connected to an output of the calculator to receive an initialization signal from said calculator during the initialization corresponding to the first ignition cycle.

5. Device as in claim 4, wherein during the first ignition generated, the first counter is preloaded, by the logic gate with function OU of the calculator, with a number n max, such that the optimum conduction time calculated is:

$$t_{c\ measured} = (t_{c\ measured} + nt\ TH_2)\ n \cdot \frac{TH_1}{TH_2}\ \bar{\delta}_i + n\ \max \cdot TH_2 \cdot \delta_i \cdot \left(n \cdot \frac{TH_1}{TH_2}\right)$$

where $\delta_i = 1$ and $\overline{\delta_i} = 0$ during said initialization phase.

6. Device as in claim 5, wherein in the absence of the control signal of the coil, said load pulse supplied to the first counter by logic clock is such that the optimum conduction time calculated is:

$$t_{c\ calculated} = n \frac{TH_1}{TH_2} [(t_{c\ measured} + nt \cdot TH_2)(\bar{\delta}_i + \bar{\delta}_p) + n \cdot \max(\delta_i + \delta_p) \cdot TH_2]$$

where $\delta_p = 1$ and $\overline{\delta_p} = 0$ when the control information of the coil is lost.

7. Device as in claims 3 or 4, wherein the load inputs of the first and third counters determine the value of the numbers nt, n max, and nd, which can be between zero and the maximum capacity of said counters.

8. Device as in any of claims 1 to 6, wherein the third counter is preloaded by an input with a value nd so that said number N sent to the output stage of the calculator is increased by the value nd and wherein the conduction time calculated $t_{c\ calculated}$ is increased by the value nd·TSD.

9. Device as in any of claim 1 to 6, wherein it comprises a logic comparator connected, on the one hand, to the outputs of the first counter and, on the other hand, to the outputs of the second counter and whose output is connected to the zero reset input of a flip-flop of type D whose clock input receives a synchronous signal with each rising edge of the angular marking signal and whose output is reset to zero by the comparator at the end of time $t_o = NB \cdot TH_1$ so that NB=NA, a second ET gate connected by one of its inputs to the output of the flip-flop of type D and receiving on its other input the interpolation signal of period TSD/n, the output of the second ET gate being connected to the third counter, and a memory connected between the third counter and the output stage of the calculator and in which the calculator number N is stored.

10. Device as in any one of claims 1 to 6, wherein the clock inputs allow the counting of periods $TH_2$, $TH_1$ and TSD/n by the first, second and third counters and determine the value of the relation:

$$n(TH_1/TH_2)$$

* * * * *